US006872898B2

(12) United States Patent
Mohtasham

(10) Patent No.: US 6,872,898 B2
(45) Date of Patent: Mar. 29, 2005

(54) LOCKABLE SWITCH MECHANISM

(75) Inventor: Medi Mohtasham, Astley (GB)

(73) Assignee: EJA Limited, Wigan (GB)

( * ) Notice: Subject to any disclaimer, the term of this patent is extended or adjusted under 35 U.S.C. 154(b) by 22 days.

(21) Appl. No.: 10/464,677

(22) Filed: Jun. 18, 2003

(65) Prior Publication Data

US 2004/0069602 A1 Apr. 15, 2004

(30) Foreign Application Priority Data

Jun. 19, 2002 (GB) ..... 0214205

(51) Int. Cl.[7] ..... H01H 9/20; H01H 27/00

(52) U.S. Cl. ..... 200/43.01; 200/43.04; 200/43.07; 200/43.13; 200/50.01

(58) Field of Search ..... 200/43.01–43.22, 200/50.01–50.4, 520–574, 318–327, 17 R, 18; 192/116.5, 129 A, 129 B

(56) References Cited

U.S. PATENT DOCUMENTS 4,395,608 A * 7/1983 Eicker et al. ..... 200/533
5,062,668 A 11/1991 Onderka et al.
5,420,385 A * 5/1995 Cooper ..... 200/43.07
5,516,993 A * 5/1996 Wecke et al. ..... 200/17 R
5,587,569 A * 12/1996 Mohtasham ..... 200/17 R
5,622,253 A * 4/1997 Wecke et al. ..... 200/43.07
5,777,284 A 7/1998 Mohtasham
6,084,185 A * 7/2000 Bachle ..... 200/43.07
6,118,087 A * 9/2000 Fukui ..... 200/43.04

FOREIGN PATENT DOCUMENTS

DE 2040046 A 6/1971

* cited by examiner

*Primary Examiner*—James R. Scott
(74) *Attorney, Agent, or Firm*—Quarles & Brady LLP; William R. Walbrun

(57) ABSTRACT

A lockable switch mechanism for a machine guard includes a switch plunger and locking and switch mechanisms. The plunger moves, upon insertion of an actuator, between two positions to actuate the switch mechanism and is locked by the locking mechanism, which has one locking member biased against a surface of the plunger and another locking member that is displaceable between locked and released positions. The plunger has an annular shoulder that displaces the first locking member when the plunger is moved. The second locking member prevents displacement of the first locking member by the plunger to thereby prevent movement of the plunger. Thus removal of the actuator is prevented unless the second locking member has been moved to the unlocked position when the machine is in a safe condition.

19 Claims, 12 Drawing Sheets

LOCKABLE SWITCH MECHANISM

CROSS-REFERENCE TO RELATED APPLICATIONS

This application claims priority to United Kingdom appl. Ser. No. 0214205, filed on Jun. 19, 2002 and published as GB 0214205D DO on Jul. 31, 2002. Related applications are published as EP 1376632 A1, published on Jan. 2, 2004, and JP 2004022549 A, published on Jan. 22, 2004.

STATEMENT OF FEDERALLY SPONSORED RESEARCH OR DEVELOPMENT

Not applicable.

BACKGROUND OF THE INVENTION

The present invention relates to a lockable switch mechanism which may be used in for example a machine guard to prevent the opening of a door of the machine guard until predetermined conditions have been established.

A lockable switch mechanism is described in U.S. Pat. No. 5,777,284, hereby incorporated by reference as though fully set forth herein. That mechanism comprises a switch plunger which is mounted in a housing and is displaceable relative to the housing along a predetermined axis between a first unlocked position and a second locked position. A locking mechanism is provided for locking the switch plunger in the second position and the switch plunger actuates a switch mechanism as a result of movement of the switch plunger between the first and second positions. The locking mechanism comprises two pivotally mounted latches which are normally biased against the switch plunger so as to engage behind an axially facing surface defined by the switch plunger when the plunger has been moved to the second position. The latches can only be withdrawn so as to permit axial displacement of the switch plunger if a plate extending transversely of the switch plunger is displaced to a latch release position. The latch releasing plate is driven by a lever mechanism the position of which is controlled by a solenoid arranged to one side of the switch mechanism housing. This arrangement works well but is relatively bulky and complex.

It is an object of the present invention to provide an improved lockable switch mechanism.

SUMMARY OF THE INVENTION

According to the present invention, there is provided a lockable switch mechanism comprising a switch plunger which is mounted in a housing and is displaceable relative to the housing along a predetermined axis between a first unlocked position and a second position, a locking mechanism for locking the switch plunger in the second position, and a switch mechanism which is actuated by movements of the switch plunger between the first and second positions, wherein the locking mechanism comprises at least one first locking member which is biased against a surface of the switch plunger and at least one second locking member which is displaceable between locked and released positions, the surface of the switch plunger against which the first locking member is biased defining a profile arranged such that movement of the switch plunger from the second to the first position causes the profile to displace the first locking member, and the second locking member when in the locked position preventing displacement of the first locking member by the profile to thereby prevent movement of the plunger from the second to the first position.

In contrast to the mechanism described in U.S. Pat. No. 5,777,284, the mechanism in accordance with the present invention relies upon a first locking member which does not prevent axial displacement of the switch plunger unless a second locking member is moved into a locked position. This means that rather than providing a relatively complex mechanism to release a latch a relatively simple and compact mechanism can be provided which is positionable either so as to maintain the first locking member in a position in which axial displacement of the switch plunger is not permitted or in a position in which the first locking member can be simply displaced by axial movement of the switch plunger. All of the necessary components can be arranged along a common axis with the switch plunger axis in a compact and reliable assembly.

Preferably, the or each first locking member comprises a locking pin extending transversely relative to the axis of displacement of the switch plunger, the locking pin being spring biased towards the switch plunger in a direction perpendicular to the switch plunger axis. Two locking pins may be provided on opposite sides of the switch plunger. The locking pins may be mounted in a housing assembly defining an aperture through which the switch plunger extends, the locking pins being spring-biased towards each other from opposite sides of the aperture by springs supported in the housing assembly. The housing assembly may comprise a frame which receives the locking pins and springs and a cover plate which retains the locking pins and springs within the assembly.

The profile may be defined by an annular shoulder extending around the switch plunger. That shoulder may be tapered so as to readily lift the locking pins away from the switch plunger if the mechanism is not in the locked condition. The or each locking member may comprise a locking arm which is displaceable in a direction parallel to the switch plunger axis and, when in the locked position, extends on the side of the first locking member remote from the switch plunger to prevent displacement of the first locking member in a direction away from the switch plunger axis. Two locking arms may be provided to lock respective locking pins against displacement relative to the switch plunger axis. The locking arms may extend from one end of a solenoid plunger which is arranged at one end of the switch plunger and is displaceable along the switch plunger axis by a solenoid winding within a solenoid housing. The solenoid may be arranged so that, when energised, the locking arms are displaced from the locked position, or alternatively may be arranged so that, when energised, the locking arms are displaced to the locked position.

A compression spring may be arranged between the switch and solenoid plungers to bias the plungers apart, and a compression spring may also be arranged between the solenoid plunger and the solenoid housing to bias the solenoid plunger towards the switch plunger. The switch plunger may be axially displaced by rotation of a cam from a datum position by insertion of an actuator into the mechanism, withdrawal of the actuator being prevented unless the cam is rotated back to the datum position, and such rotation being prevented by the locking mechanism if the or each second locking member is in the locked position.

BRIEF DESCRIPTION OF THE DRAWINGS

An embodiment of the present invention will now be described, by way of example, with reference to the accompanying drawings, in which.

DETAILED DESCRIPTION OF THE PREFERRED EMBODIMENTS

Figure 1:
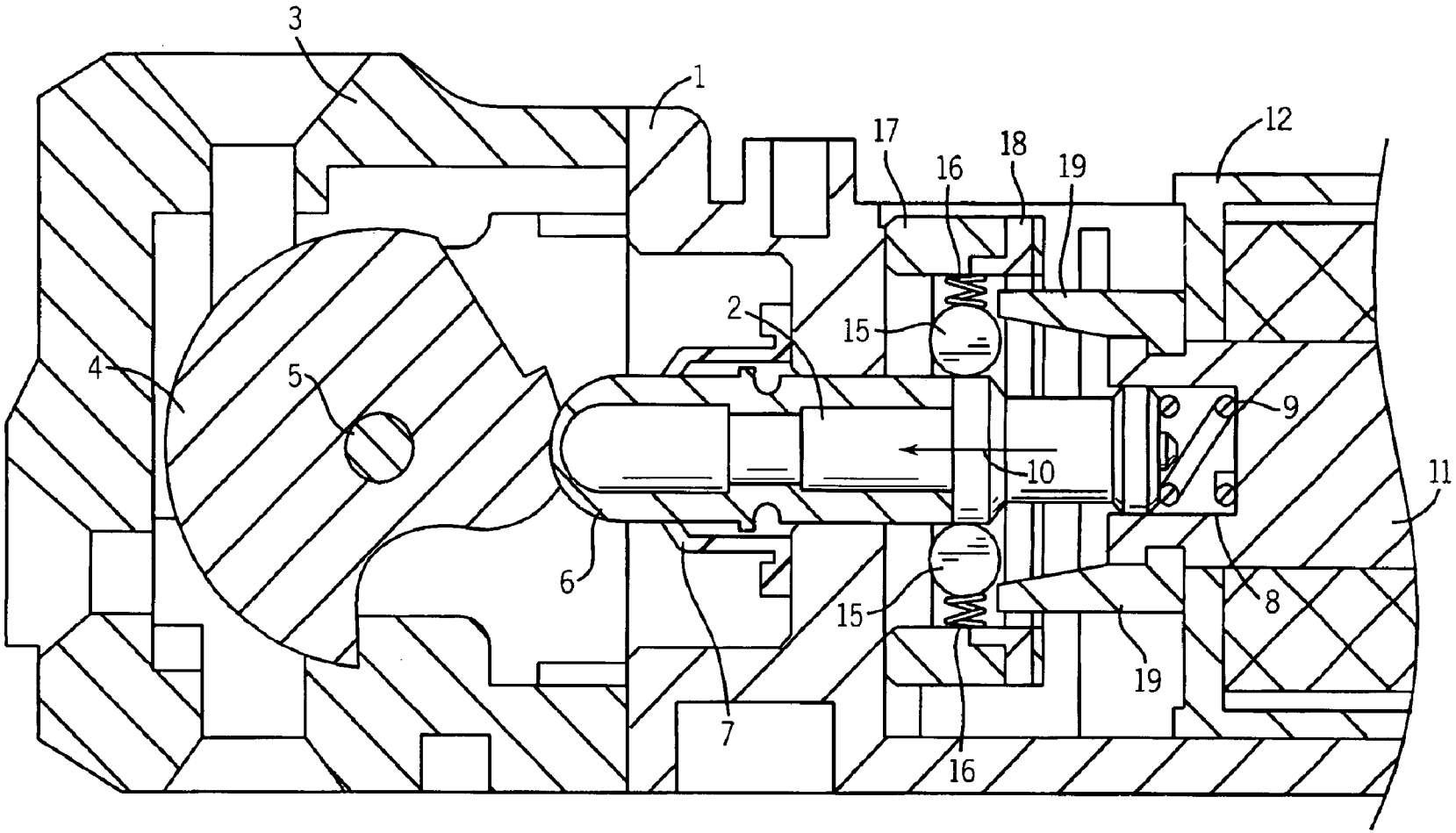
FIG. 1 is a schematic cut-away view of a locking switch mechanism in accordance with the present invention with the switch in an unlocked condition.

Referring to FIG. 1, the illustrated lockable switch mechanism comprises a housing 1 in which a plunger 2 is slidable and which supports a head assembly 3 supporting a rotatable cam 4, the cam 4 being rotatable about a pin 5. The plunger 2 comprises a metal core supporting an outer casing 6 which is slidably received in a sealing cap 7. The plunger 2 is symmetrical about its longitudinal axis and is slidable relative to the housing 1 along that axis.

The end of the plunger 2 remote from the cam 4 is received in a bore 8, a compression spring 9 being located within the bore 8 so as to bias the plunger 2 in the direction indicated by arrow 10. The bore 8 is formed in the end of a solenoid plunger 11 which is received within a solenoid housing 12. Energisation of a solenoid winding (not shown) in the solenoid housing 12 drives the solenoid plunger 11 to the right in FIG. 1. Denergisation of the solenoid results in the solenoid plunger 11 being moved to the left in FIG. 1 by a compression spring 13 (FIG. 2) which is located between the solenoid housing 12 and a locking fork 14 which is engaged in a groove extending around the end of the solenoid plunger 11 in which the bore 8 is formed.

Two locking pins 15 are positioned on either side of the plunger 2, the locking pins 15 being biased by springs 16 against the plunger 2. The locking pins 15 and springs 16 are retained within a housing assembly made up from a frame 17 and a cover plate 18. It will be seen that with the plunger 2 in the position shown in FIG. 1 the pins 15 are held at a distance from the axis of the plunger 2 such that they obstruct the passage of arms 19 supported by the locking fork 14 in the direction of the arrow 10.

Figure 2:
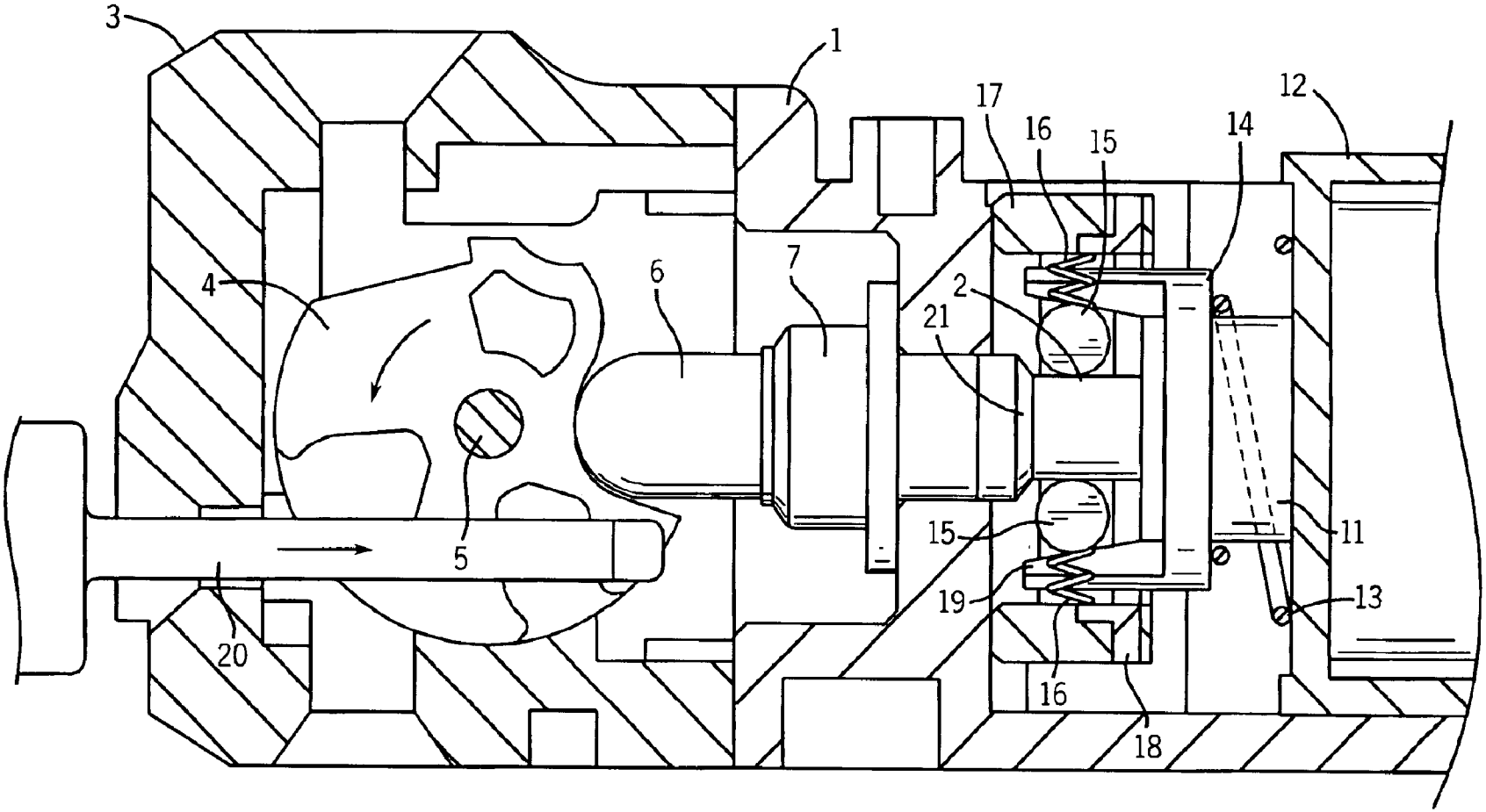
FIG. 2 illustrates the mechanism of FIG. 1 after the insertion of an actuator to switch the mechanism and locking of the mechanism.

FIG. 2 shows the assembly of FIG. 1 after the insertion of an actuator 20 into the head assembly 3 so as to cause rotation of the cam 4. Such rotation of the cam 4 enables the plunger 2 to move towards the pin 5. As a result a profile 21 in the form of an annular shoulder on the plunger 2 is moved to the left of the locking pins 15. The locking pins 15 are biased towards each other so as to remain in contact with the plunger 2, thereby enabling the arms 19 of the locking fork 14 to pass the locking pins 15.

The actuator 20 and cam 4 are shaped such that insertion of the actuator into the head assembly 3 causes the cam to rotate from a datum position, that is the position of the cam 4 as shown in FIG. 1. In known manner, the actuator defines projections (not shown) which engage in recesses defined by the cam 4 (as shown in FIG. 2) so that once the cam 4 has been rotated from the datum position the actuator 20 cannot be withdrawn from the head assembly 3 unless the cam 4 has been rotated back to the datum position. An actuator and cam mechanism of this general type is described in the abovementioned U.S. Pat. No. 5,777,284.

Figure 3:
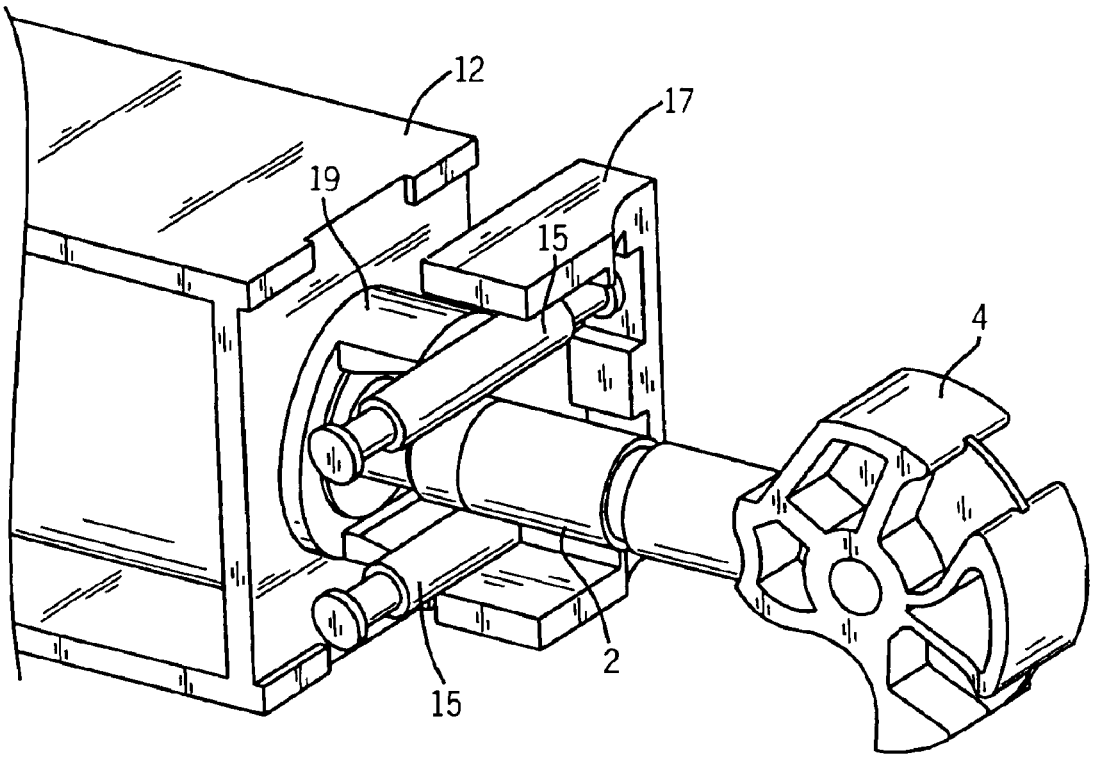
FIG. 3 is a partial perspective view of some of the components of the mechanism of FIGS. 1 and 2 showing those components in the positions adopted when the switch is unlocked as shown in FIG. 1.
Figure 4:
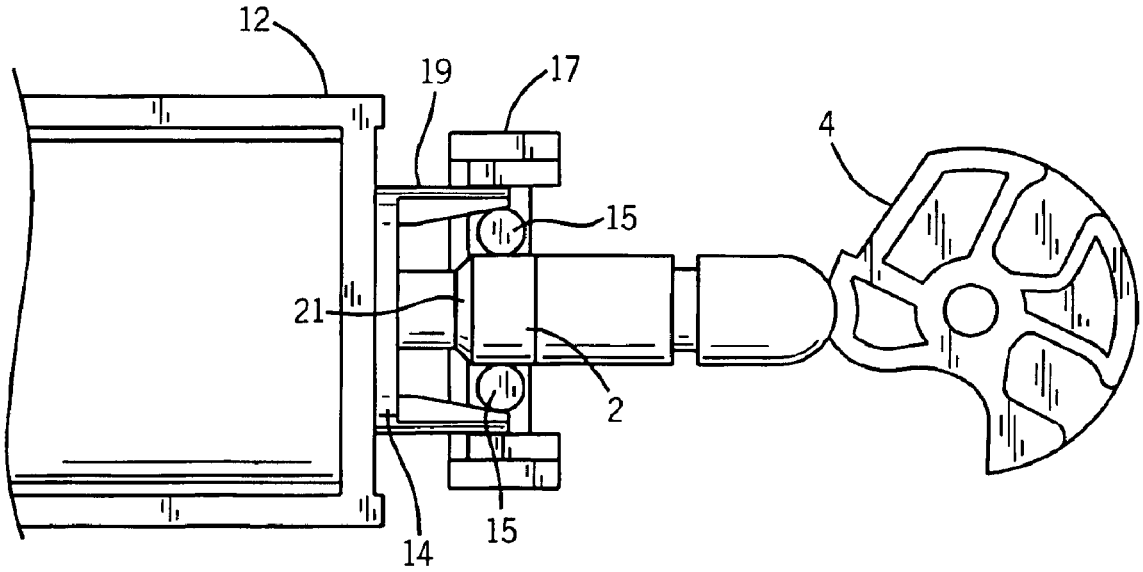
FIG. 4 is a side view of the components of FIG. 3.
Figure 5:
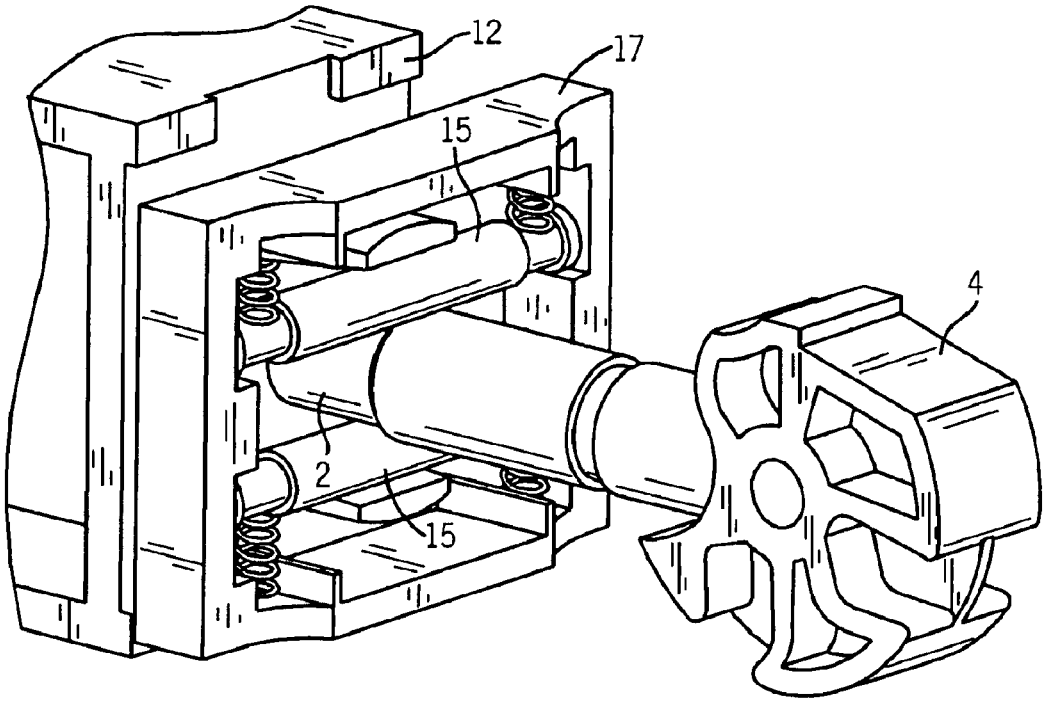
FIG. 5 is a partial perspective view of the components shown in FIGS. 3 and 4 with those components in the switch locked position corresponding to FIG. 2.
Figure 6:
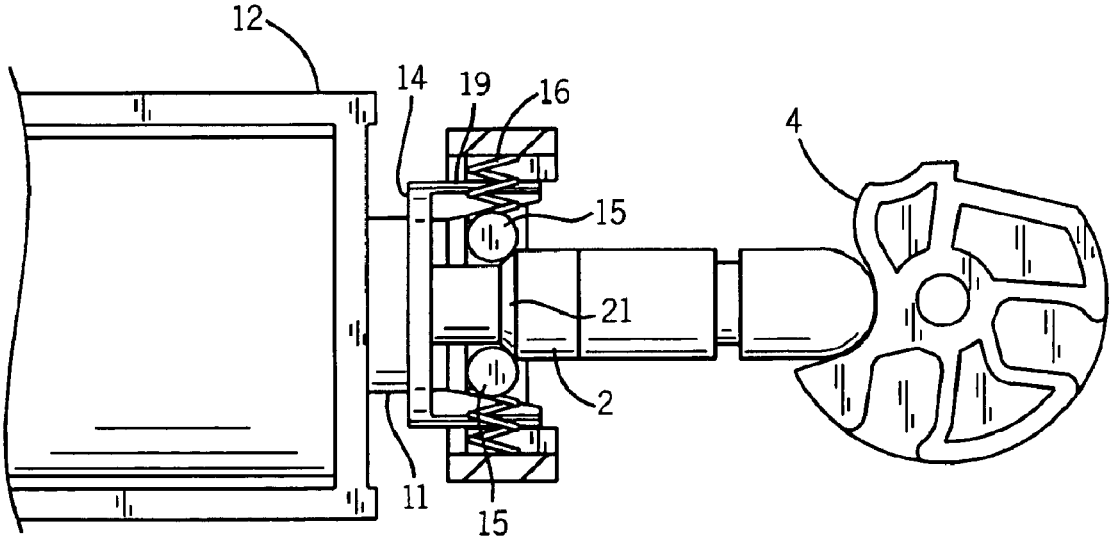
FIG. 6 is a side view of the components shown in FIG. 5.

FIGS. 3 and 4 show the assembly in the unlocked condition. In FIG. 3, the solenoid plunger 11 has been moved to the position it assumes when the solenoid is energised and the plunger 2 is in the position in which it is displaced by the cam 4 as far as possible towards the solenoid housing 12. As a result the spacing between the pins 15 is such that even if the solenoid is then deenergised the arms 19 cannot move past the pins 15. The pins 15 therefore impose no restraint on the axial displacement of the plunger 2. In contrast, as shown in FIGS. 5 and 6, if the cam 4 is then rotated to displace the plunger 2 so that the pins 15 can drop down the profiled shoulder 21 defined by the plunger 2, the springs 16 urge the locking pins 15 towards each other so as to engage behind the shoulder 21. Deenergisation of the solenoid then results in the arms 19 being extended past the pins 15, restraining the pins 15 against movement away from each other. Any attempt therefore to drive the plunger 2 towards the solenoid housing 12 will be resisted as a result of the pins 15 jamming between the profile 21 and the arms 19.

Figure 7:
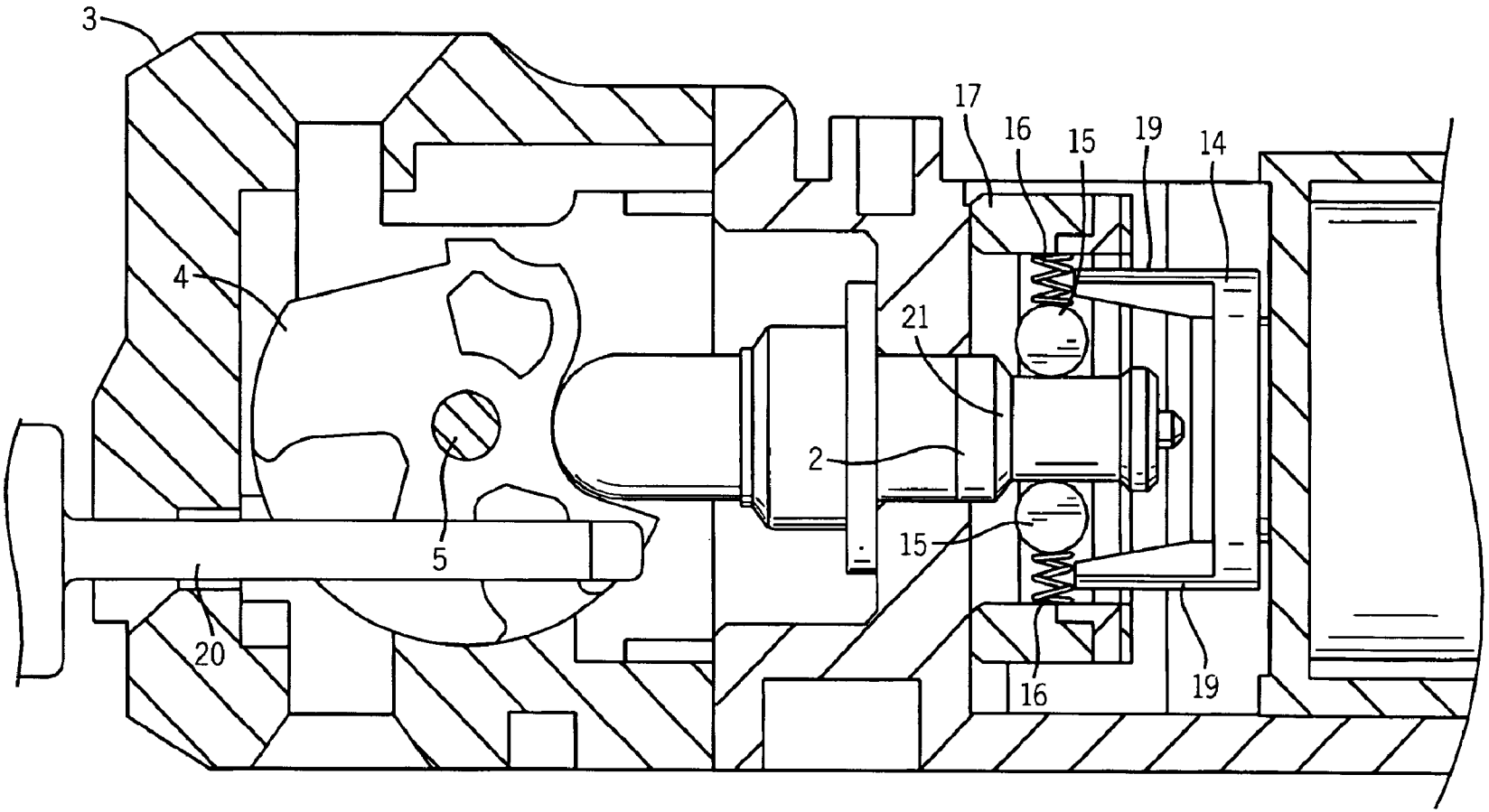
FIG. 7 shows the mechanism of FIGS. 1 to 6 after insertion of an actuator but before locking of the mechanism.

FIG. 7 shows the assembly after displacement of the plunger 2 towards the cam pin 5. Unless the solenoid is energised, the arms 19 of the locking fork 14 will engage around the pins 15 as shown in FIGS. 5 and 6. In the configuration shown in FIG. 7 however the solenoid has been energised, displacing the arms 19 to the right. There is then nothing to stop the locking pins 15 being moved apart against the biasing force provided by the springs 16. Thus if the actuator 20 was to be withdrawn from the head assembly 3 this would result in the displacement of the plunger 2 to the right in FIG. 7, such movement being permitted as the tapered surface of the shoulder 21 would push against and force apart the two locking pins 15.

Figure 8:
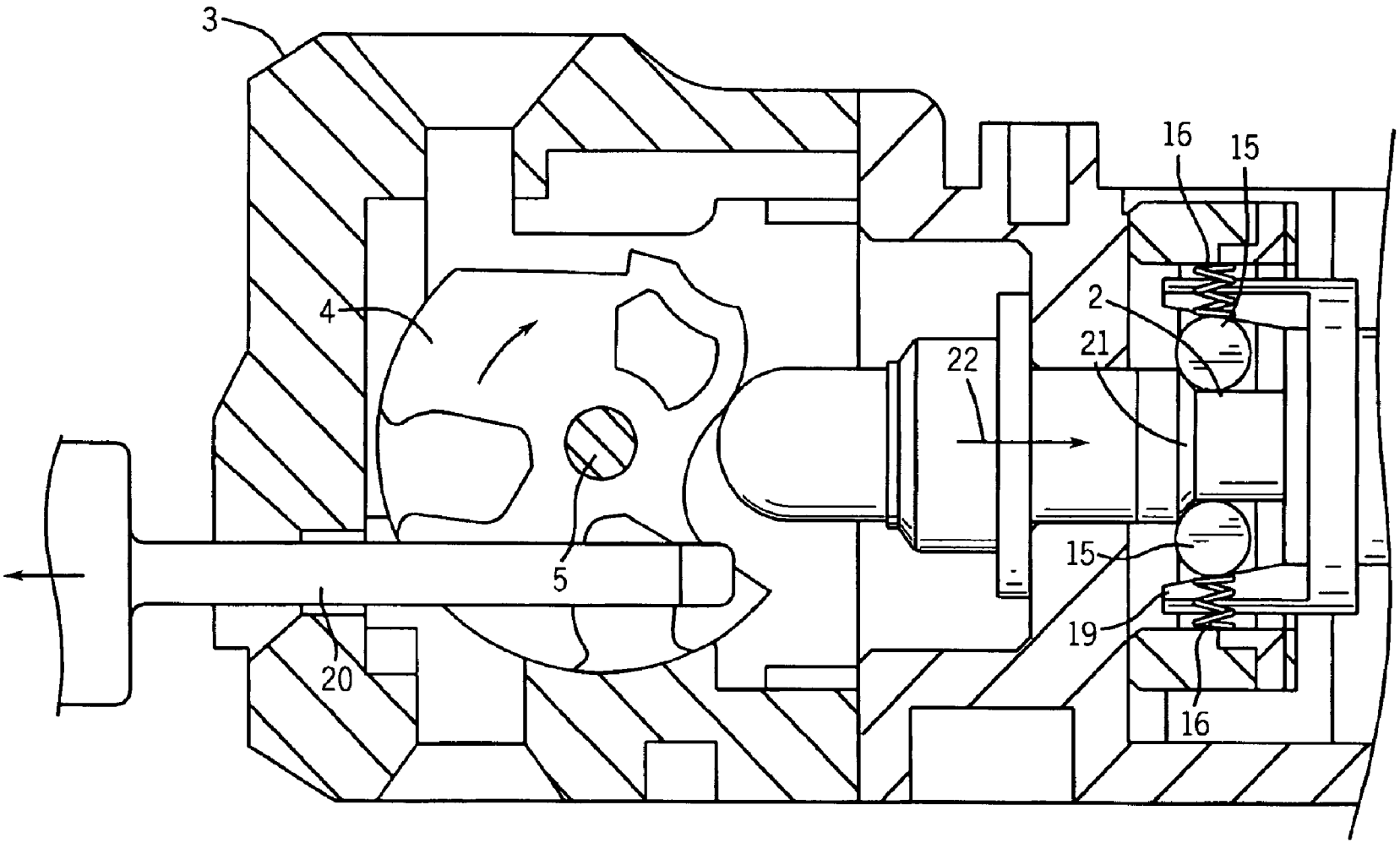
FIG. 8 illustrates the application of a force to withdraw the actuator when the mechanism is locked.

Referring to FIG. 8, this shows the assembly if an attempt is made to withdraw the actuator 21 when the assembly is in the configuration shown in FIG. 2, that is with the pins 15 locked in position by the arms 19. Pulling on the actuator 21 causes the cam 4 to rotate in the clockwise direction in FIG. 8, thereby applying an axial force to the plunger 2 and causing the plunger to move in the direction indicated by arrow 22. Such displacement is however resisted by the locking pins 15 which bear against the profile 21. The arms 19 prevent the pins 15 moving apart and thus further axial displacement of the plunger 2 is prevented.

Figure 9:
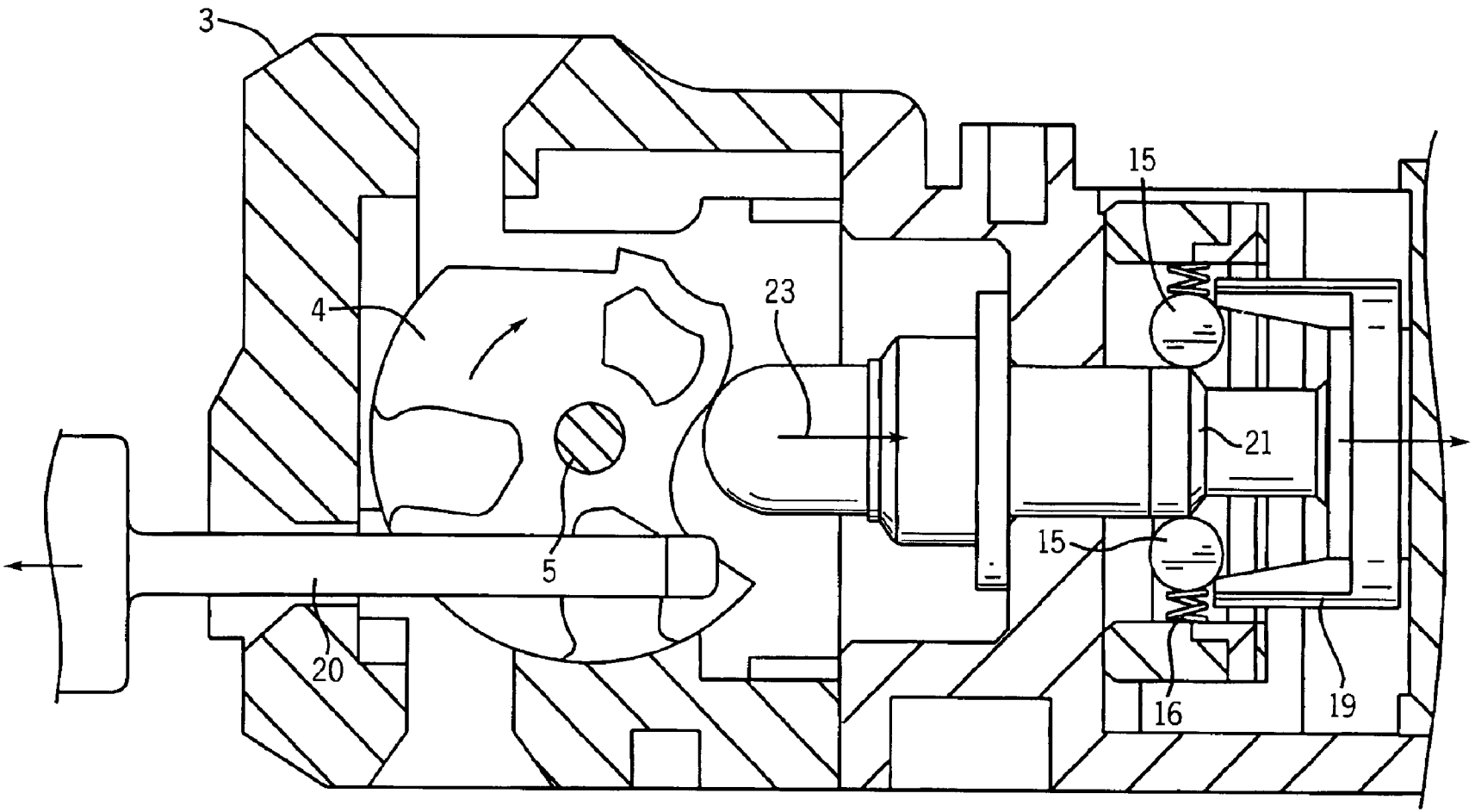
FIG. 9 illustrates the mechanism after unlocking of the mechanism and partial withdrawal of the actuator.

In contrast, if the solenoid is energised so as to displace the arms 19 to the position shown in FIG. 7, and the actuator 20 is pulled out of the head assembly 3, rotation of the cam 4 is not resisted by contact between the pins 15 and the profile 21 and as a result the plunger 2 can be displaced in the direction of arrow 23 as shown in FIG. 9.

Figure 10:
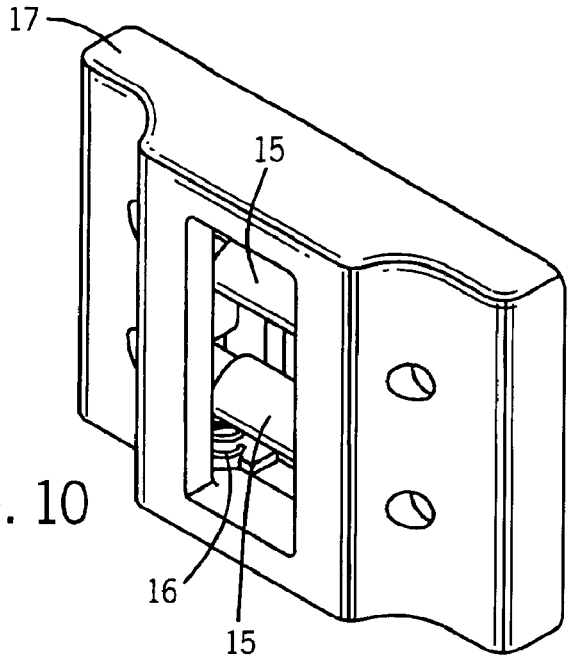
FIG. 10 is a perspective view of assembled components of the locking mechanism and FIG. 11 is an exploded view of the components making up the assembly of FIG. 10.
Figure 11:
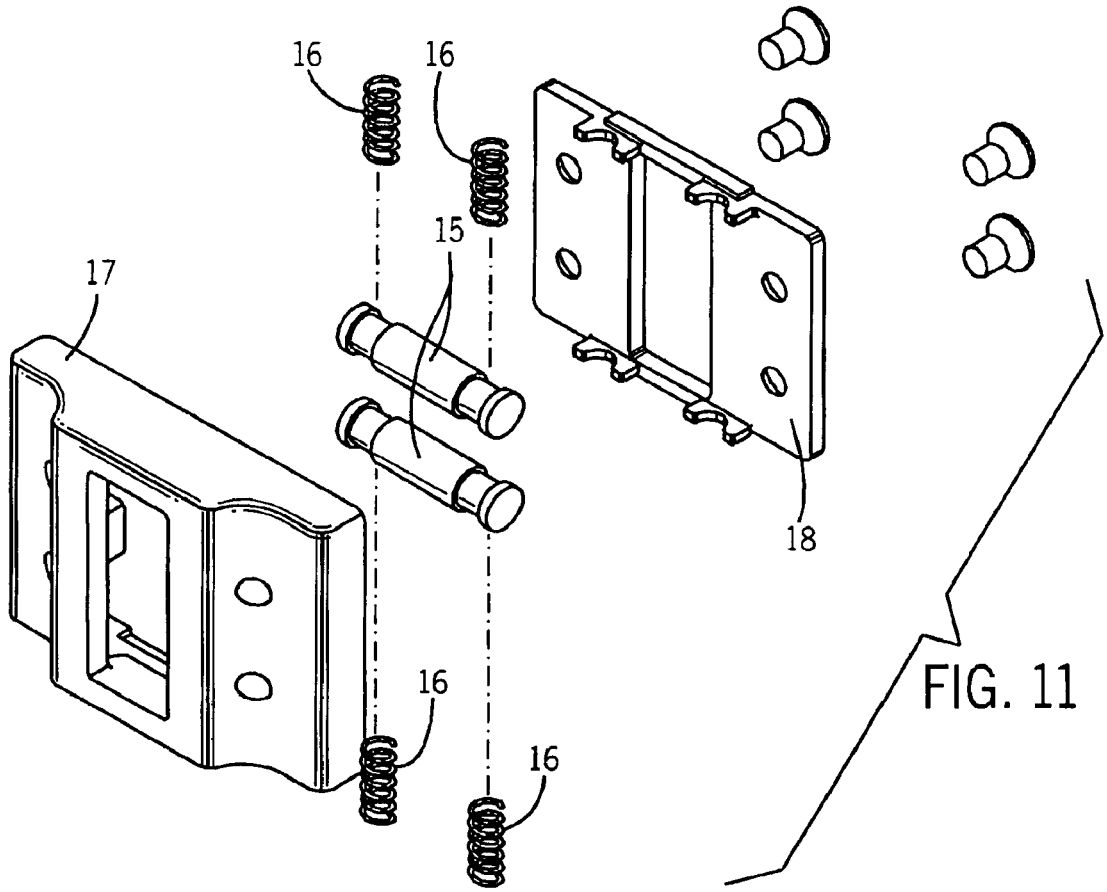

FIG. 10 illustrates the housing assembly for the locking pins 15 and springs 16 and FIG. 11 shows the components of the assembly of FIG. 10 in exploded form.

Figure 12:
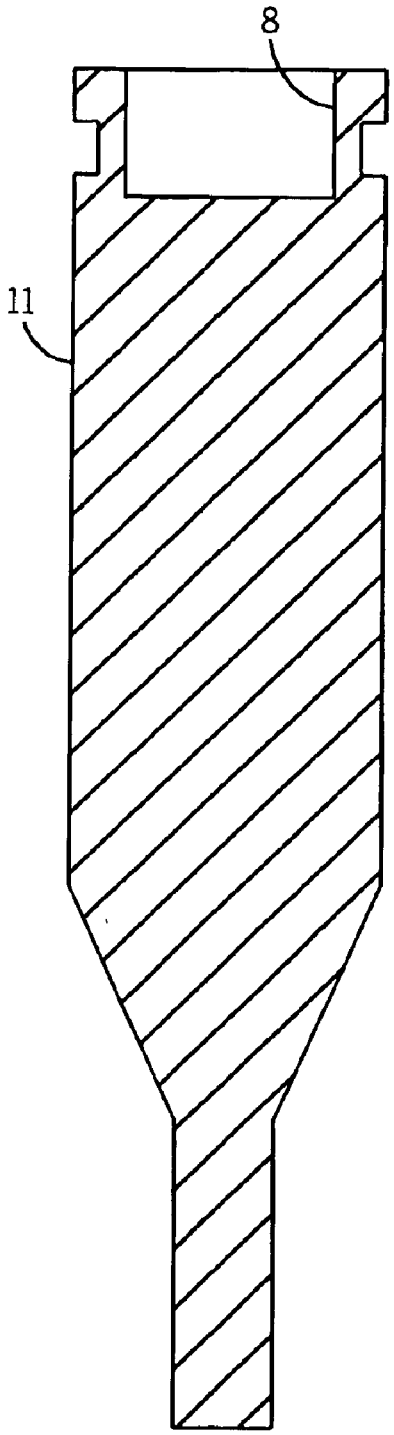
FIG. 12 is a sectional view through a solenoid plunger incorporated in the mechanism of FIGS. 1 to 11.
Figure 13:
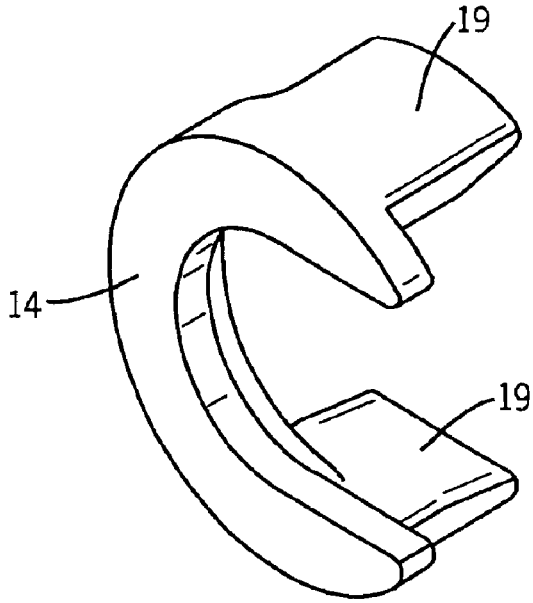
FIG. 13 is a perspective view of a solenoid locking fork incorporated in the mechanism of FIGS. 1 to 12.
Figure 14:
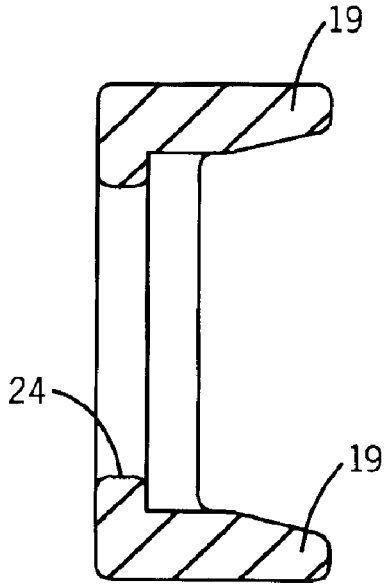
FIG. 14 is a sectional view through the solenoid locking fork of FIG. 13.

FIG. 12 is a sectional view through the solenoid plunger 11 showing the bore 8 and the groove extending around the end of the plunger 11 in which the bore 8 is provided, that groove being engaged by the locking fork 14 shown in FIGS. 13 and 14.

Referring to FIGS. 13 and 14, the locking fork which supports the locking arms 19 has a C-shaped body defining an inwardly projecting edge 24, that edge being received in the slot formed around the end of the solenoid plunger 11 shown in FIG. 12. The inner faces of the fork arms 19 are tapered such that, on energisation of the solenoid, the arms 19 are released easily from engagement with the pins 15.

Given the structure of the plunger and locking fork combination, it is a relatively easy matter to assemble the combination. In an alternative arrangement it would of course be possible to fabricate the plunger 11 and the locking fork 14 including the locking fork arms 19 as a single piece component.

Figure 15:
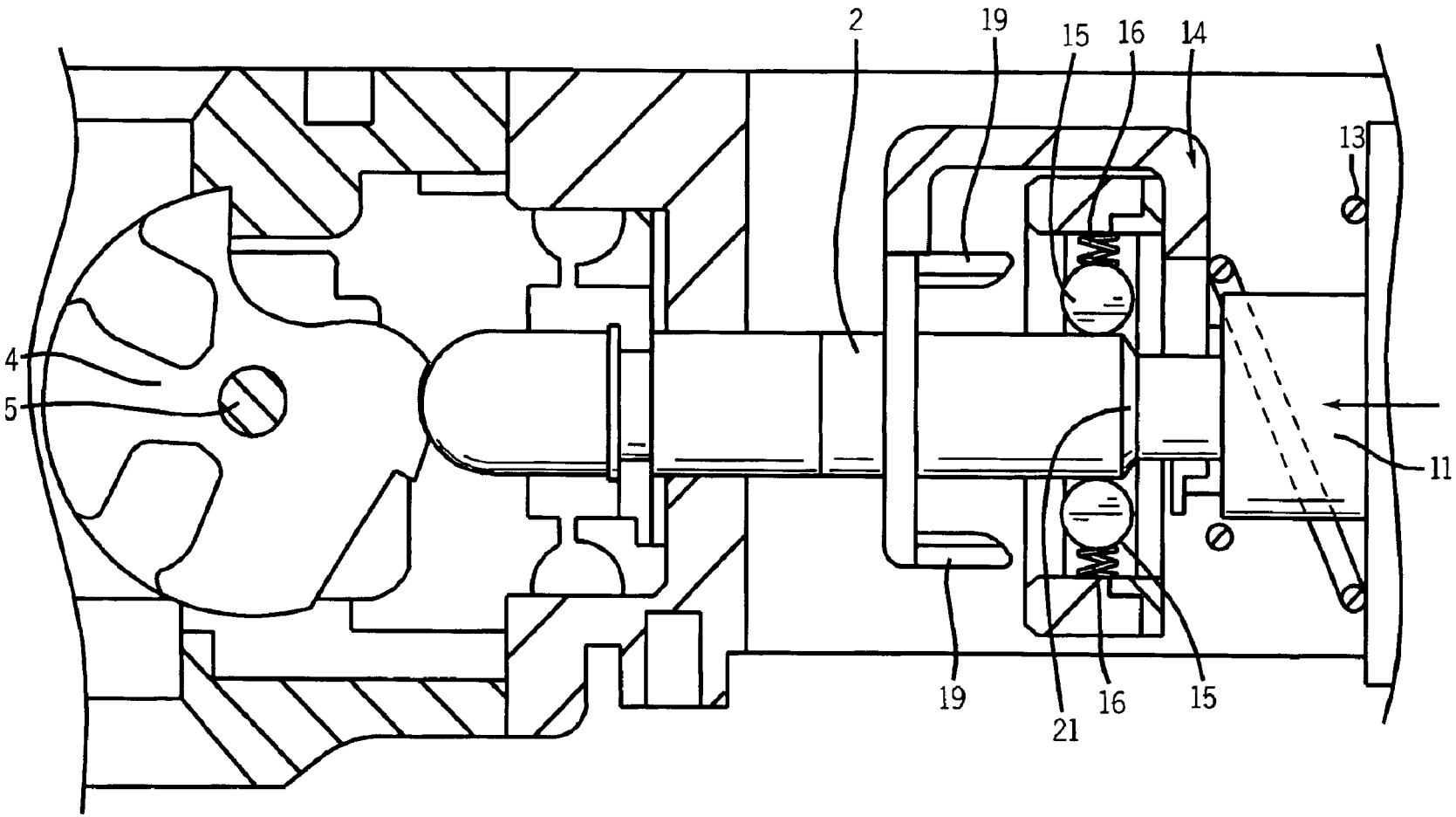
FIG. 15 is a schematic cut-away view of a second locking switch mechanism in accordance with the present invention with the switch in an unlocked condition.
Figure 16:
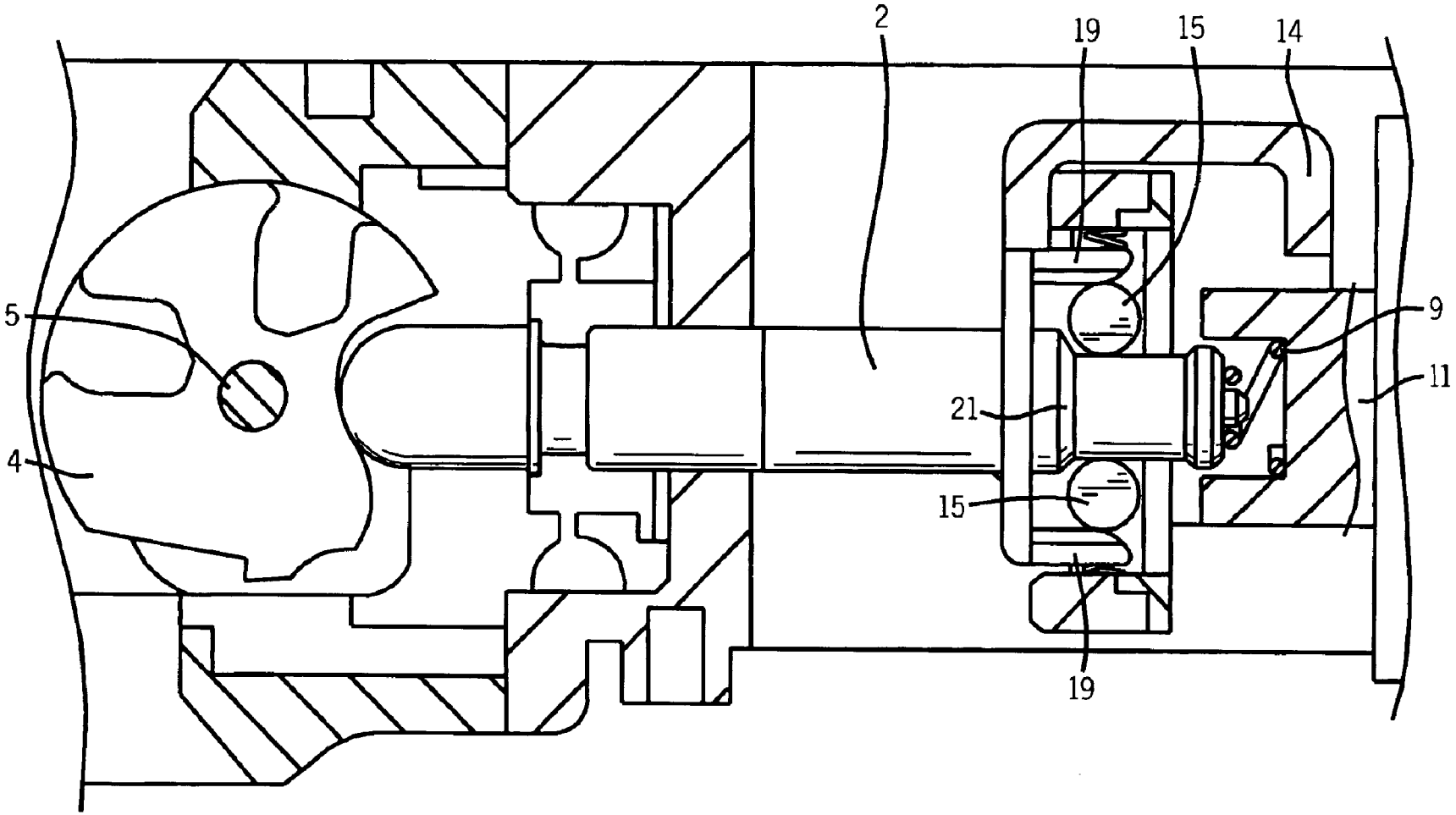
FIG. 16 illustrates the mechanism of FIG. 15 after the insertion of an actuator and locking of the mechanism.
Figure 17:
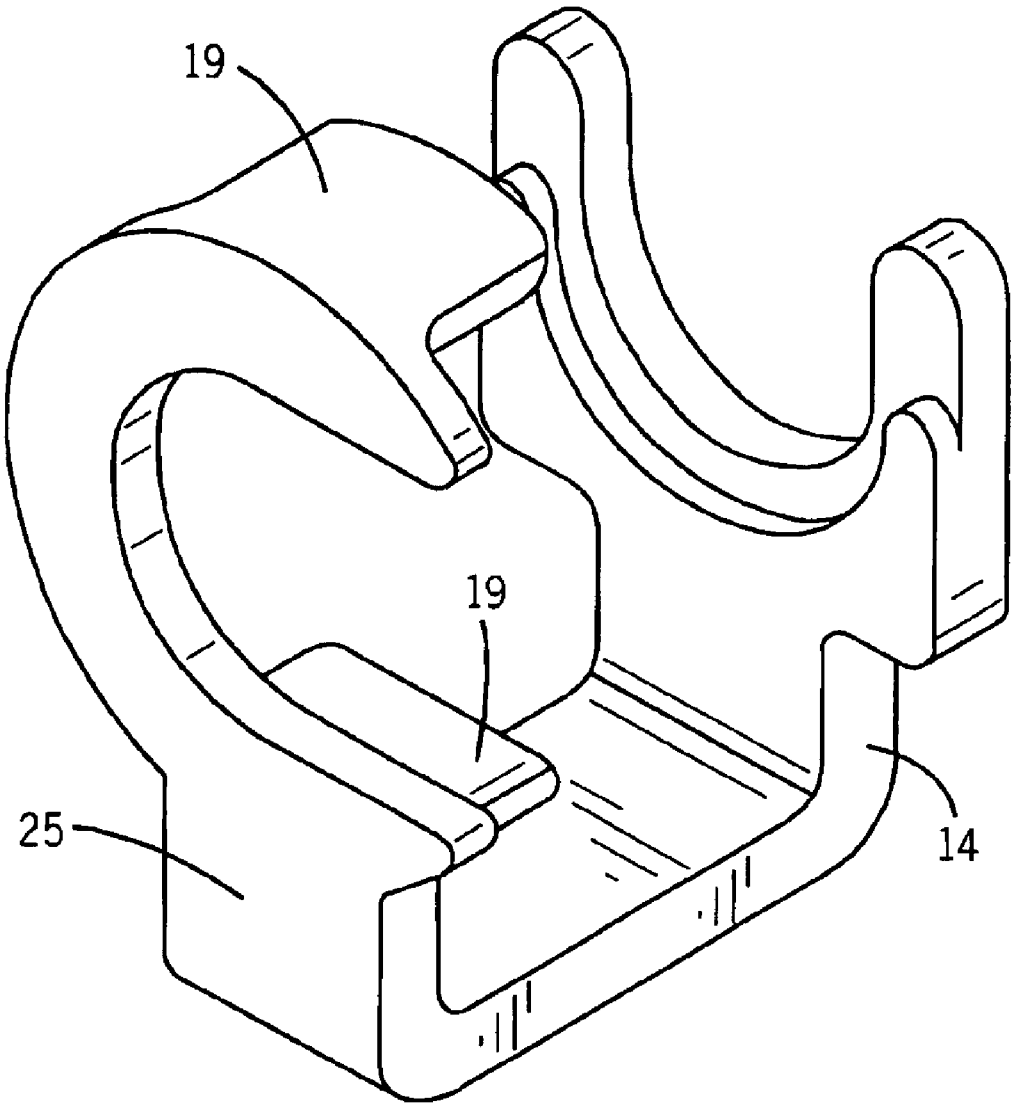
FIG. 17 is a perspective view of a locking fork incorporated in the mechanism of FIGS. 15 and 16.

In the embodiment of FIGS. 1 to 14, energisation of the solenoid is necessary to release the locking mechanism. The solenoid is not energised accept when it is desired to release the locking mechanism. In the event of a power failure when the mechanism is locked, it is not possible to unlock the mechanism and therefore it is not possible to release the actuator from the cam. The actuator can only be released after the supply of power is restored. In some applications, this can be a significant disadvantage. FIGS. 15 to 17 illustrate a second embodiment of the invention in which this disadvantage is avoided by relying upon a solenoid which is energised when the switch is locked and de-energised when the switch locking mechanism is released.

Referring to FIGS. 15 to 17, components of the second embodiment which are equivalent to components of the first embodiment shown in FIGS. 1 to 14 are identified by the same reference numerals. Thus, in the second embodiment a plunger 2 is biased against a cam 4 by a compression spring 9. The plunger 2 is located between a pair of locking pins 15 which are biased against the sides of the plunger 2 by springs 16. The plunger 2 defines a shoulder 21 behind which the locking pins 15 engage when the plunger 2 is displaced towards a pin 5 about which the cam rotates. FIG. 15 shows the locking mechanism before insertion of an actuator into the assembly so as to rotate the cam. In this configuration the locking pins 15 cannot engage behind the shoulder 21. FIG. 16 shows the mechanism after displacement of the plunger 2 as a result of rotation of the cam 4. In this configuration the pins 15 are biased inwards by the springs 16 so as to engage behind the shoulder 21. FIG. 16 shows the locking pins 15 after displacement of a locking fork 14 so that locking arms 19 extend outside the locking pins 15, thereby preventing the locking pins 15 from moving outwards. In the condition shown in FIG. 16, the plunger 2 cannot therefore be moved to the right in FIG. 16 as such movement would be prevented by inter-engagement between the shoulder 21 and the locking pins 15.

The locking fork 14 is mounted on solenoid plunger 11 and is biased towards the cam 4 by a compression spring 13. If the solenoid is de-energised, the spring 13 ensures that the locking arms 19 are displaced away from the locking pins 15. The mechanism is therefore unlocked in that axial movement of the plunger 2 is not obstructed. If the solenoid is energised, the plunger 11 is driven to the right in FIG. 16 such that, providing the plunger 2 is in the position shown in FIG. 16, the locking arms 19 can engage outside the locking pins 15, thereby locking the mechanism.

With the arrangement illustrated in FIGS. 15 and 16, the switch will remain locked only so long as the solenoid is energised. When it is desired to unlock the mechanism, the solenoid is simply de-energised. With such an arrangement it will be appreciated that, in the event of a power failure, the mechanism is automatically unlocked. In some applications this is a significant advantage. In contrast, with the mechanism illustrated in FIGS. 1 to 14, unlocking of the mechanism requires energisation of the solenoid and therefore in the event of a power failure it would not be possible to release the actuator 20 from the cam 4.

FIG. 17 illustrates the structure of the locking fork 14 of the embodiment of FIGS. 15 and 16 in greater detail. It will be noted that the locking arms 19 are mounted on an L-shaped extension 25 of the locking fork 14, the locking fork 14 defining a C-shaped body defining an inwardly projecting edge that is received in a slot formed around the end of the solenoid plunger 11.

It should be appreciated that merely preferred embodiments of the invention have been described above. However, many modifications and variations to the preferred embodiments will be apparent to those skilled in the art, which will be within the spirit and scope of the invention. Therefore, the invention should not be limited to the described embodiments. To ascertain the full scope of the invention, the following claims should be referenced.

What is claimed is:

1. A lockable switch mechanism comprising a switch plunger which is mounted in a housing and is displaceable relative to the housing along a predetermined axis between a first unlocked position and a second position, a locking mechanism for locking the switch plunger in the second position, and a switch mechanism which is actuated by movement of the switch plunger between the first and second positions, wherein the locking mechanism comprises at least one first locking member which is biased against a surface of the switch plunger and at least one second locking member which is displaceable between locked and released positions, the surface of the switch plunger against which the first locking member is biased defining a profile arranged such that movement of the switch plunger from the second to the first position causes the profile to displace the first locking member, and the second locking member when in the locked position preventing displacement of the first locking member by the profile to thereby prevent movement of the plunger from the second position to the first unlocked position.

2. The mechanism of claim 1, wherein each first locking member includes a locking pin extending transversely relative to the axis of displacement of the switch plunger, the locking pin being spring biased towards the switch plunger in a direction perpendicular to the axis.

3. The mechanism of claim 2, wherein the first locking member includes two locking pins located on opposite sides of the switch plunger.

4. The mechanism of claim 3, wherein the two locking pins are mounted in a housing assembly defining an aperture through which the switch plunger extends, the locking pins being spring-biased towards each other from opposite sides of the aperture by springs supported in the housing assembly.

5. The mechanism of claim 3, wherein the housing assembly comprises a frame which receives the locking pins and springs and a cover plate which retains the locking pins and springs within the assembly.

6. The mechanism of claim 2, wherein the profile is defined by an annular shoulder extending around the switch plunger.

7. The mechanism of claim 1, wherein each locking member includes a locking arm which is displaceable in a direction parallel to the switch plunger axis and, when in the locked position, extends on the side of the first locking member remote from the switch plunger to prevent displacement of the first locking member in a direction away from the switch plunger axis.

8. The mechanism of claim 7, wherein each locking arm defines a tapered surface that contacts the or a respective first locking member when in the locked position, the taper being arranged to facilitate release of the locking arm when the locking arm is displaced to the released position.

9. The mechanism of claim 3, wherein each locking member includes a locking arm which is displaceable in a direction parallel to the switch plunger axis and, when in the locked position, extends on the side of the first locking member remote from the switch plunger to prevent displacement of the first locking member in a direction away from the switch plunger axis.

10. The mechanism of claim 9, wherein two locking arms are provided to lock respective locking pins against displacement relative to the switch plunger.

11. The mechanism of claim 10, wherein the locking arms extend from one end of a solenoid plunger which is arranged at one end of the switch plunger and is displaceable along the switch plunger axis by a solenoid winding within a solenoid housing.

12. The mechanism of claim 11, wherein a compression spring is arranged between the switch and solenoid plungers to bias the plungers apart.

13. The mechanism of claim 11, wherein a compression spring is arranged between the solenoid plunger and the solenoid housing to bias the solenoid plunger towards the switch plunger.

14. The mechanism of claim 1, wherein the switch plunger is biased against a cam that is rotatable from a datum position by insertion of an actuator into the mechanism and which engages the actuator to prevent its removal unless the cam is rotated to the datum position, the locking mechanism being arranged to prevent removal of the actuator if the switch plunger has been displaced by the cam to the second position and the second locking member has been displaced to the locked position.

15. A lockable switch mechanism, comprising:

a switch plunger movable along a predetermined axis between a first unlocked position and a second position;

a locking mechanism for locking the switch plunger in the second position; and a switch mechanism actuated by movement of the switch plunger between the first and second positions;

wherein the locking mechanism includes at least one first locking member biased against a surface of the switch plunger such that movement of the switch plunger from the second to the first position displaces the first locking member, and wherein the locking mechanism also includes at least one second locking member displaceable between locked and released positions such that when in the locked position it prevents displacement of the first locking member to thereby prevent movement of the switch plunger from the second position to the first unlocked position.

16. A lockable switch mechanism, comprising:

a switch plunger movable along a predetermined axis between a first unlocked position and a second position to actuate a switch mechanism, the switch plunger being biased against a cam that is rotatable from a datum position by insertion of an actuator and which engages the actuator to prevent its removal unless the cam is rotated to the datum position.; and a locking mechanism for locking the switch plunger in the second position including locking arms extending from one end of a solenoid plunger arranged at one end of the switch plunger and displaceable along the switch plunger axis by a solenoid winding, the locking mechanism including at least one first locking member biased against a surface of the switch plunger such that movement of the switch plunger from the second to the first position displaces the first locking member, the locking mechanism also including at least one second locking member displaceable between locked and released positions such that when in the locked position it prevents displacement of the first locking member to thereby prevent movement of the switch plunger from the second position to the first unlocked position.

17. The mechanism of claim 16, wherein the locking mechanism is arranged to prevent removal of the actuator if the switch plunger has been displaced by the cam to the second position and the second locking member has been displaced to the locked position.

18. The mechanism of claim 16, further including a compression spring between the switch and solenoid plungers to bias the plungers apart.

19. The mechanism of claim 16, further including a compression spring between the solenoid plunger and a solenoid housing to bias the solenoid plunger towards the switch plunger.

* * * * *